US011732419B2

(12) United States Patent
Cerqueira et al.

(10) Patent No.: US 11,732,419 B2
(45) Date of Patent: Aug. 22, 2023

(54) OIL RESISTANT ARTICLE

(71) Applicant: Mativ Holdings, Inc., Alpharetta, GA (US)

(72) Inventors: Flávia Queiroz Cerqueira, Pirai (BR); Vincent Motin, Clohars-Carnoet (FR)

(73) Assignee: Mativ Holdings, Inc., Alpharetta, GA (US)

( * ) Notice: Subject to any disclaimer, the term of this patent is extended or adjusted under 35 U.S.C. 154(b) by 157 days.

(21) Appl. No.: 17/317,076

(22) Filed: May 11, 2021

(65) Prior Publication Data

US 2021/0348336 A1 Nov. 11, 2021

Related U.S. Application Data

(60) Provisional application No. 63/023,047, filed on May 11, 2020.

(51) Int. Cl.

| | |
|---|---|
| ***D21H 19/34*** | (2006.01) |
| ***D21H 17/17*** | (2006.01) |
| ***D21H 17/26*** | (2006.01) |
| ***D21H 17/28*** | (2006.01) |
| ***D21H 19/84*** | (2006.01) |
| ***D21H 21/16*** | (2006.01) |

(52) U.S. Cl.
CPC ..... *D21H 19/34* (2013.01); *D21H 17/17* (2013.01); *D21H 17/26* (2013.01); *D21H 17/28* (2013.01); *D21H 19/84* (2013.01); *D21H 21/16* (2013.01)

(58) Field of Classification Search
CPC ..... D21H 19/34; D21H 19/84; D21H 17/17; D21H 17/26; D21H 17/28; D21H 21/16
USPC ..... 162/137
See application file for complete search history.

(56) References Cited

U.S. PATENT DOCUMENTS

| | | | |
|---|---|---|---|
| 2016/0340833 | A1 | 11/2016 | Pang et al. |
| 2020/0002572 | A1 | 1/2020 | Spender et al. |

FOREIGN PATENT DOCUMENTS

| | | | |
|---|---|---|---|
| CN | 110670412 | A | 1/2020 |
| JP | 2005171390 | A | 6/2005 |
| JP | 2014234556 | A | 12/2014 |
| JP | 2018031092 | A | 3/2018 |
| WO | WO 03/002342 | A1 | 1/2003 |
| WO | WO 2017/178604 | A1 | 10/2017 |
| WO | WO 2018/094130 | A1 | 5/2018 |

OTHER PUBLICATIONS

Haan, BfR Regulatory Status Sekisui Speciality Chemicals America, LLC, dated Oct. 25, 2019, 1 Page.
CP Kelco CMC Carboxymethyl Cellulose Guidelines for Proper Dissolution, 2 Pages. www.cpkelco.com.
Hann, FDA Regulatory Status of SELVOL Polyvinyl Alcohol 425, Sekisui Specialty Chemicals America, LLC, dated Oct. 25, 2019, 1 Page.
Moilanen, Food Contact Status—Finnfix BBP Products, CP Kelco, dated Feb. 6, 2019, 2 Pages.
CP Kelco, Safety Data Sheet FINNFIX® BBP H15S, Apr. 15, 2018, pp. 1-10.
Sekisui Safety Data Sheet for SELVOL™ Polyvinyl Alcohol, Copolymer, SDS ID:SSC10002, Issue Date May 18, 2015, pp. 1-11.
Sekisui, SELVOL 425 Polyvinyl Alcohol For Improved Oil Resistance and Ink Holdout, SELVOL Polyvinyl Alcohol, 2 Pages.
Sekisui, A Versatile Performer In Paper And Paperboard Applications, SELVOL Polyvinyl Alcohol, 9 Pages.
International Search Report and The Written Opinion of the International Searching Authority, or the Declaration Corresponding to Application No. PCT/IB2021/054025 dated Jul. 26, 2021.

*Primary Examiner* — Mark Halpern
(74) *Attorney, Agent, or Firm* — Dority & Manning, P.A.

(57) ABSTRACT

An oil resistant article is described that does not contain any fluorocarbon compounds. The oil resistant article includes a basesheet formed from pulp fibers. The basesheet is coated on at least one surface with an oil resistant coating. The basesheet is formed without having to use any highly refined fibers. Various chemical treatments are incorporated into the basesheet and the oil resistant coating is formed from particularly selected polymers that produces an oil resistant article having a relatively high permeability and excellent oil resistant properties.

22 Claims, 1 Drawing Sheet

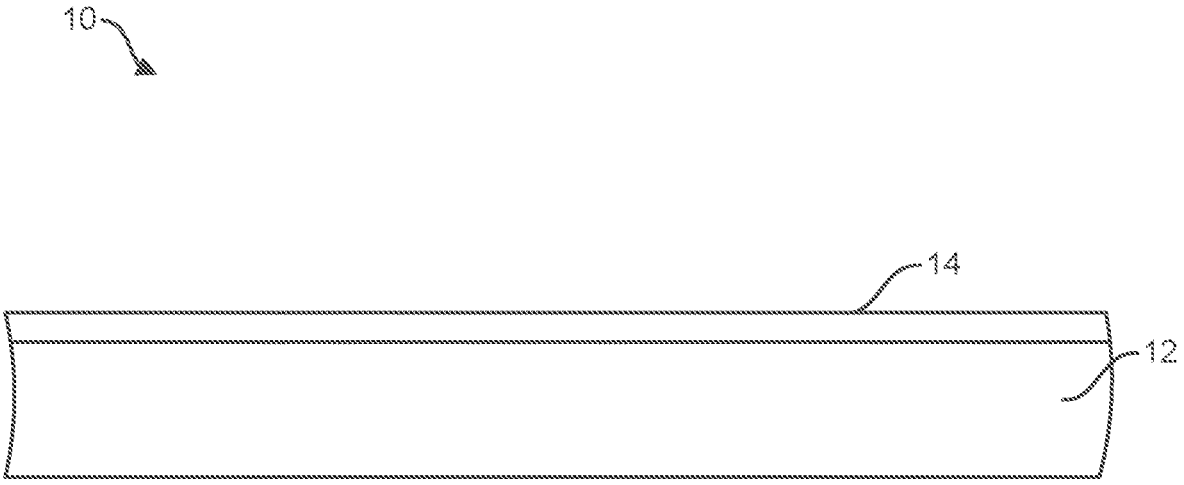
10
14
12

OIL RESISTANT ARTICLE

RELATED APPLICATIONS

The present application is based upon and claims priority to U.S. Provisional Patent Application Ser. No. 63/023,047, having a filing date of May 11, 2020, which is incorporated herein by reference.

BACKGROUND

A variety of mechanical and chemical treatments are used in the papermaking industry to impart various properties to the finished paper. Resistance to oil and/or grease penetration is a particularly desirable property for paper products used in many applications. For instance, grease and oil resistance is needed in packaging for fatty or greasy materials, such as fatty or greasy food products. Grease and oil resistant papers are also needed for other food containers, release liners, labels, pet food containers, and the like.

In the past, various chemicals have been incorporated into paper products in order to impart oil resistance. Conventionally, for instance, fluorocarbon compounds have been employed as surface sizes or coatings to impart oil penetration resistance. Fluorocarbons, in general, have very low surface energies and are not wet easily by oil-based materials. Although fluorocarbon compounds are well suited for providing oil resistance, recent government regulations have limited their use.

In addition to fluorocarbon compounds, various other chemicals and polymers have been suggested. For instance, silicone polymers and compounds have been used to coat papers in the past. Silicone, however, has various drawbacks and disadvantages. For instance, silicone can transfer to adjacent surfaces.

In still other embodiments, thermosetting polymers have been used in order to impart oil and chemical resistance. Incorporating thermosetting polymers into the paper, however, prevents the paper product from later being recycled. The presence of thermosetting polymers can significantly interfere with the biodegradable properties of the paper.

Mechanical treatments that have been used in the past in order to provide some oil resistance include highly refining fibers that are used to make the paper. By using highly refined fibers, the resulting paper has a lower permeability and thus provides some resistance to oil and grease, especially when coated with the materials described above. Using highly refined fibers, however, significantly increases the cost of the product and requires a dramatic increase in the use of energy to produce the product.

In view of the above, a need exists for an improved article, such as a paper product, that is resistant to chemicals, such as oil and grease. In particular, a need exists for an oil resistant paper product that does not contain fluorocarbon chemicals and does not require the use of highly refined fibers.

SUMMARY

In general, the present disclosure is directed to an oil resistant article. In accordance with the present disclosure, the oil resistant article can be made almost exclusively from recyclable materials and can be free of fluorocarbon compounds. The oil resistant article can be made from a coated paper substrate. The paper substrate can contain pulp fibers that have not been highly refined making the product economical to produce. The construction of the paper layer in combination with one or more coating materials produces an article having excellent oil resistance for use in all different types of applications, such as a food wrap.

For example, in one embodiment, the present disclosure is directed to an oil resistant article that includes a paper basesheet comprising pulp fibers. The pulp fibers can have a degree of refining of about 85° SR or less, and about 50° SR or more. In one aspect, the pulp fibers can contain hardwood fibers in an amount greater than about 60% by weight. The pulp fibers, for instance, can be a mixture of hardwood fibers and other fibers, such as softwood fibers, or can be made exclusively from hardwood fibers. The basesheet can have an inherent Gurley permeability of less than about 5,000 s/100 mL, such as less than about 3,000 s/100 mL, and generally greater than about 1,000 s/100 mL. The paper basesheet can have a basis weight of from about 18 gsm to about 80 gsm, such as from about 30 gsm to about 50 gsm. The basesheet can include a first side and a second and opposite side.

In accordance with the present disclosure, an oil resistant coating is located on at least one side of the basesheet. In one embodiment, for instance, an oil resistant coating can be applied to the first side and to the second side of the basesheet. The oil resistant coating can comprise a cellulose derivative, a polyvinyl alcohol polymer, a starch, a vegetable protein-based polymer, or mixtures thereof. The oil resistant article made in accordance with the present disclosure can be free of fluorocarbon compounds. The oil resistant article can have a final Gurley permeability of less than about 50,000 s/100 mL and can have a permeability of greater than about 3,000 s/100 mL.

In one aspect, the oil resistant coating is made from a carboxymethyl cellulose. The carboxymethyl cellulose can have a viscosity of less than about 800 cPs and generally greater than about 5 cPs. The oil resistant coating can be applied to the basesheet in an amount of from about 0.01% to about 10% by weight of the article, such as from about 2% to about 8% by weight of the article.

Various different additives can be incorporated into the basesheet for further improving strength and/or oil resistance. For example, the basesheet can contain a binder. The binder can comprise a polymer such as a carboxymethyl cellulose, starch or mixtures thereof. In one aspect, the article is formed from a basesheet containing a first carboxymethyl cellulose binder and a second carboxymethyl cellulose that is contained in an oil resistant coating that has been topically applied to the basesheet. The first carboxymethyl cellulose can be different from the second carboxymethyl cellulose.

A sizing agent can also be incorporated into the basesheet. The sizing agent, for instance, can be an alkyl ketene dimer. The sizing agent can be incorporated into the basesheet in an amount from about 0.5% to about 4% by weight.

The oil resistant article of the present disclosure can be formed without incorporating any filler particles either into the basesheet or the oil resistant coating. Alternatively, some filler particles may be incorporated into the basesheet, such as in an amount less than about 10% by weight, such as in an amount less than 5% by weight. In addition, the oil resistant article can also be silicone free and can be produced without any acid treatment, such as used in producing parchment paper.

As described above, articles made in accordance with the present disclosure have excellent oil resistance. For instance, the article can have a Kit oil rating of greater than about 3, such as greater than about 4, and less than about 12, such as less than about 11, such as from about 3 to about 8.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIG. 1 is a cross-sectional view of one embodiment of an oil resistant article made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to an oil resistant article well suited for use in many and diverse applications. For example, the oil resistant article of the present disclosure can be in the form of a coated paper well suited for use as food packaging where oil and/or grease resistance is desired. Oil resistant articles in accordance with the present disclosure can also be used to replace wax coated paper in numerous applications. For example, the oil resistant article can be used to produce labels, different types of food wraps, pet food containers, candy wraps, and oven sheets, such as microwave oven sheets. The oil resistant articles made in accordance with the present disclosure can also be used in the medical field as part of a patient care wrap or as a wrapping material for medical instruments and devices.

Oil resistant articles made in accordance with the present disclosure offer various different advantages and benefits. For example, the oil resistant articles can be produced without containing any fluorocarbon compounds. For instance, the article can contain fluorocarbon compounds in an amount less than 0.05% by weight, and, in one embodiment, can be completely free of fluorocarbon compounds. Articles made in accordance with the present disclosure can also be silicone-free and can be made without subjecting the product to any acid treatment such as in the production of parchment paper. Of particular advantage, oil resistant articles can be made in accordance with the present disclosure from a paper substrate or basesheet that does not contain highly refined pulp fibers. In the past, in order to improve oil resistance, many prior products contained highly refined pulp fibers which significantly increased the amount of energy needed to produce the product in addition to significantly increasing the cost. In accordance with the present disclosure, however, oil resistant articles can be produced from paper substrates without containing highly refined fibers and can be produced with a combination of elements that provide the desired oil resistant properties. Further, oil resistant articles made in accordance with the present disclosure can have a relatively simple or elegant construction without containing multiple layers of paper. For instance, in one aspect, the oil resistant article of the present disclosure can contain a single paper layer combined with one or two coatings applied to at least one side of the paper substrate. In this manner, the resulting product has low stiffness properties and is easy to manipulate, such as when wrapping other products.

Referring to FIG. 1, one embodiment of an oil resistant article generally 10 made in accordance with the present disclosure is shown. FIG. 1 represents a cross-sectional view of the product 10. As shown, in this embodiment, the oil resistant article 10 includes a paper basesheet 12 formed from pulp fibers. The basesheet 12, for instance, can be a wetlaid paper layer. In other embodiments, however, the basesheet 12 can been air formed, foam formed, or the like. The basesheet 12 includes a first surface opposite a second surface. Applied to the first surface of the basesheet 12 is an oil resistant coating 14 as shown in FIG. 1. The oil resistant coating 14 can appear as a separate layer or can be applied so that it becomes impregnated in the top layer of the basesheet 12. The oil resistant coating 14 is formed from an oil resistant polymer. Suitable polymers that may be used to coat the basesheet 12 include a cellulose derivative, a polyvinyl alcohol polymer, a starch, a vegetable protein-based polymer (such as derived from soy) or mixtures thereof. As shown in FIG. 1, the oil resistant article 10 can be made exclusively from a single paper layer or basesheet 12 combined with the oil resistant coating 14. Alternatively, the oil resistant article can include a second coating (not shown) applied to the opposite surface of the basesheet 12.

As described above, in one embodiment, the basesheet 12 is a wetlaid pulp fiber paper layer. The basesheet 12 can be formed from an aqueous suspension of fibers. Pulp fibers that may be used include hardwood fibers, softwood fibers, thermomechanical pulp, flax fibers, other crop fibers, and plant waste fibers. Bleached pulp and unbleached pulp may be used. In one embodiment, in forming the basesheet, the aqueous suspension of fibers is deposited onto a porous forming surface (such as a flat wire) that allows water to drain thereby forming the basesheet. As the paper web is formed and dried, the paper can be gathered, crimped, embossed, and/or calendered.

The basesheet is primarily formed of pulp fibers. For instance, greater than about 90%, such as greater than about 95% by weight of the basesheet can comprise pulp fibers. In one embodiment, relatively short fibers are used to form the basesheet. For example, the average fiber length can be less than about 4 mm, such as less than about 3 mm, such as less than about 2 mm, and generally greater than about 0.2 mm, such as greater than about 0.5 mm. For example, in one embodiment, the fiber furnish used to form the basesheet contains primarily hardwood fibers, which have a shorter fiber length. Hardwood fibers can be present in the fiber furnish (based on the total weight percent of fibers present) of greater than about 60% by weight, such as greater than about 70% by weight, such as greater than about 80% by weight, such as greater than about 90% by weight, such as greater than about 95% by weight. In one embodiment, the fiber furnish contains exclusively hardwood fibers (100% by weight). In an alternative embodiment, the fiber furnish contains hardwood fibers combined with softwood fibers. The softwood fibers can be present in an amount from about 3% to about 40% by weight, such as from about 20% to about 5% by weight.

One of the advantages of the present disclosure is the ability to produce an oil resistant article from the basesheet without having to use highly refined fibers. The amount the pulp fibers have been refined is referred to as the freeness value. The freeness value (° SR) measures generally the rate at which a dilute suspension of refined fibers may be drained. The freeness is measured by the Schopper Riegler Method for drainability. As used herein, freeness is measured according to Test NORM EN ISO 5267-1. Pulp fibers used to construct the basesheet of the present disclosure, for instance, can have a degree of refining of less than about 85° SR, such as less than about 83° SR, such as less than about 80° SR, such as less than about 78° SR, such as less than about 75° SR, such as less than about 73° SR, and generally greater than about 50° SR, such as greater than about 60° SR, such as greater than about 70° SR.

Incorporating fibers into the basesheet having the above level of refining can lead to the basesheet having a relatively high porosity. Porosity or permeability can be measured according to the Gurley Test, using a Gurley permeability tester, such as Gurley Model 4340. The test can be conducted according to ISO Test 5636. The Gurley Test measures air permeability as a function of the time required for a specified amount of air to pass through a specified area of a separator under a specified pressure. The units are reported in seconds per 100 mL. Lower numbers therefore can represent substrates with more openness or higher porosity. Basesheets made according to the present disclosure can have an inherent Gurley permeability of less than about 5,000 s/100 mL, such as less than about 4,000 s/100 mL, such as less than about 3,000 s/100 mL, such as less than about 2,000 s/100 mL, and generally greater than about 500 s/100 mL, such as greater than about 1,000 s/100 mL. As used herein, the "inherent" permeability of the basesheet is the permeability of the basesheet prior to applying any oil resistant coatings or in any way artificially increasing the permeability through perforations or other similar treatments.

Basesheets made according to the present disclosure generally have a basis weight of greater than about 18 gsm, such as greater than about 21 gsm, such as greater than about 25 gsm, such as greater than about 30 gsm, such as greater than about 35 gsm, such as greater than about 40 gsm, such as greater than about 45 gsm. The basis weight of the basesheet is generally less than about 80 gsm, such as less than about 70 gsm, such as less than about 60 gsm, such as less than about 50 gsm, such as less than about 45 gsm, such as less than about 40 gsm.

In one aspect, basesheets made according to the present disclosure may be made without containing any filler particles. For example, the basesheets can be free of titanium oxide particles, calcium carbonate particles, magnesium oxide particles, or the like. Instead, the basesheet can be made from pulp fibers alone or in combination with various chemical treatments.

Alternatively, filler particles can be incorporated into the basesheet. The filler particles can be titanium oxide particles, calcium carbonate particles, magnesium oxide particles, or mixtures thereof. The filler particles can be present in the basesheet in an amount less than about 10% by weight, such as in an amount of less than about 5% by weight, such as in an amount less than about 3% by weight, and generally in an amount greater than about 0.5% by weight, such as in an amount greater than 2.5% by weight.

Chemical treatments that can be applied to the basesheet and/or incorporated into the basesheet include binders, sizing agents, and/or wet strength agents. For example, in one embodiment, a binder can be incorporated into the basesheet that helps increase integrity, increase oil resistance and/or increase runnability. The binder can comprise any suitable polymer, such as a film-forming thermoplastic polymer. In one aspect, the binder is a natural polymer obtained directly or derived from natural ingredients, such as plants. The binder, for instance, can be a cellulose derivative, guar gum, pectin, starch, mixtures thereof or the like. Binders can be applied to the basesheet at the wet end of the process if the basesheet is formed through a wetlaid process. For instance, the binder can be incorporated into the fiber furnish prior to being deposited onto a forming surface or applied prior to drying. In one aspect, a cellulose derivative binder, such as a carboxymethyl cellulose can be incorporated into the basesheet. The carboxymethyl cellulose can be combined with the pulp fibers in relatively small amounts. For instance, the resulting basesheet can contain the carboxymethyl cellulose binder in an amount less than about 2% by weight, such as in an amount less than about 1.5% by weight, such as in an amount less than about 1% by weight, such as in an amount less than about 0.5% by weight. The carboxymethyl cellulose binder can be present in the basesheet in an amount greater than about 0.05% by weight, such as in an amount greater than about 0.08% by weight, such as in an amount greater than about 0.1% by weight.

In one embodiment, the binder incorporated into the basesheet is a starch, such as a cationic starch. The starch can be added to the pulp fibers alone or in combination with other binders, such as the carboxymethyl cellulose binder as described above. The starch can be incorporated into the basesheet generally in an amount greater than about 0.05% by weight, such as in an amount greater than about 0.1% by weight, such as in an amount greater than about 0.5% by weight, such as in an amount greater than about 1% by weight, such as in an amount greater than about 2% by weight, such as in an amount greater than about 3% by weight. The starch can be incorporated into the basesheet in an amount less than about 5% by weight, such as in an amount less than about 4% by weight. In one particular embodiment, for example, a cationic starch can be incorporated into the basesheet in an amount from about 3% to about 4% by weight.

In one embodiment, the basesheet contains a carboxymethyl cellulose binder and a starch binder as described above.

In addition to one or more binders, a sizing agent can also be incorporated into the basesheet. The sizing agent is also applied at the wet end of the papermaking process. Applying a sizing agent to the basesheet can improve the integrity of the basesheet and improve the liquid repellant properties. In one embodiment, the sizing agent applied to the basesheet is an alkyl-ketene dimer. The amount of sizing agent added to the basesheet can be from about 0.1% to about 2%, preferably from about 0.5% to about 1.5% by dry weight of the basesheet.

Still another chemical component that can be incorporated into the basesheet is a wet strength agent. A wet strength agent may reduce the potential for degradation of the basesheet if the latter is placed in contact with a liquid, such as water. Typically, the wet strength agent may be chosen from polyamides, such as epichlorohydrin resin, a polyamine-epichlorohydrin resin, a poly(aminoamide)-epichlorohydrin resin; an alkylsuccinic anhydride; a polyvinylamine; an oxidized polysaccharide. Typically, the amount of wet strength agent is from 0.1% to 2%, preferably from 0.5% to 1.5% by dry weight of the basesheet.

As shown in FIG. 1, in addition to the basesheet 12, the oil resistant article of the present disclosure further includes at least one oil resistant coating applied to one surface of the basesheet. The oil resistant coating is formed from an oil resistant polymer. In one aspect, the oil resistant polymer can be a film-forming polymer. Particular examples of oil resistant polymers that may be used to form the coating include a cellulose derivative, a polyvinyl alcohol polymer, a starch, a vegetable protein-based polymer or mixtures thereof. Of particular advantage, the oil resistant coating can be formed exclusively from one or more oil resistant polymers without having to incorporate filler particles into the coating.

In one embodiment, the oil resistant coating is formed from a carboxymethyl cellulose polymer. In general, the carboxymethyl cellulose can have a viscosity of from about 5 cPs to about 800 cPs. In one aspect, a carboxymethyl cellulose polymer can be produced that has relatively shorter molecular chains for better oil resistance. For example, a carboxymethyl cellulose polymer can be selected that has a viscosity of less than about 800 cPs, such as less than about 400 cPs, such as less than about 100 cPs, such as less than about 80 cPs. The viscosity of the carboxymethyl cellulose polymer is generally greater than about 5 cPs, such as greater than about 15 cPs, such as greater than about 25 cPs, such as greater than about 35 cPs, such as greater than about 45 cPs, such as greater than about 55 cPs, such as greater than about 60 cPs. The viscosity of polymer materials disclosed herein including the carboxymethyl cellulose polymer is measured according to test DIN 53019.

In one aspect, the carboxymethyl cellulose incorporated into the oil resistant coating can an oxidated carboxymethyl cellulose. The carboxymethyl cellulose may be used in a highly-purified, cold water-soluble form.

Alternatively, the oil resistant coating can be formed from a polyvinyl alcohol polymer. In one aspect, the polyvinyl alcohol selected has an intermediate degree of hydrolysis. For instance, polyvinyl alcohol is synthesized from polyvinyl acetate and can be formed into different products that vary in molecular weight and hydrolysis level. Polyvinyl alcohol that is well suited for use in the present disclosure typically has a hydrolysis level of greater than about 93% and generally less than about 97%, such as from about 95.5% to about 96.5%. The viscosity of the polyvinyl alcohol can generally be less than about 50 cPs, such as less than about 40 cPs, such as less than about 35 cPs, and generally greater than about 10 cPs, such as greater than about 15 cPs, such as greater than about 20 cPs, such as greater than about 25 cPs. The viscosity of the polyvinyl alcohol can be measured according to test DIN 53019. In one embodiment, the polyvinyl alcohol polymer can be combined with a starch in forming the oil resistant coating.

In still another embodiment, the oil resistant coating can be formed from a starch. Any suitable starch can be applied to one or more surfaces of the basesheet. In one aspect, the starch is a modified corn starch having a relatively low viscosity. For example, the starch can have a viscosity of from about 20 cPs to about 80 cPs, such as from about 30 cPs to about 55 cPs. The starch can be derived from a starch source having at least 90 percent amylopectin, and preferably a waxy maize. Starch derivatives include the tertiary amino alkyl ester resulting from the reaction of a starch under alkaline conditions; with a dialkyl amino alkyl halide.

In still another embodiment, the oil resistant coating can be formed from a vegetable protein-based polymer. The preferred vegetable protein is a soy protein. These materials are built up of a group of about 25 amino adds and derived from processing of soybeans. The protein is derived by removing the oil and hull and processing the soybean. These materials are reduced in size and extracted with an alkaline solution isolating the soy protein in its native form along with low molecular weight sugars. The protein material can be hydrolyzed at high pH and reflux conditions to break the protein into smaller units. The protein is amphoteric having cationic and anionic reactive sites. The combination of hydrophobic and charged regions maintains the globular protein subunits and makes them self-associating. Hydrolization under alkaline conditions causes the protein to unfold and re-associate by hydrophobic and hydrophillic regions. Under hydrolysis conditions; hydrophilic anionic groups are more exposed reducing solution viscosity. Optionally the soy protein can be further modified by carboxylating the protein yielding a soy protein of reduced viscosity. Preferred vegetable proteins herein have a specific gravity ranging from about 1.007 at a solids content in solution of 5% by weight (30° C.) to about 1.05 at 20% solids content (TAPPI TISIO 104-01 Technical Information Sheet). The bulk dry specific gravity is higher. The preferred soy protein herein has a specific gravity dry of about 1.38. One vegetable protein herein is a hydrolyzed amphoteric soybean protein. This material is hydrolyzed as a 13.5% solids solution in a solution of ammonium hydroxide to yield a solution pH of about 9-10.4. Thereafter the material is acidified. The preferred hydrolyzed amphoteric soybean protein has a pH as a 15% slurry around 4.0 to 4.5. The protein is then typically isolated and stored as a dry flake or powder.

The oil resistant coating is applied to the basesheet in an amount sufficient to provide the necessary oil resistant properties. In general, the oil resistant coating comprises greater than about 0.01% by weight, such as greater than about 0.5% by weight, such as greater than about 1% by weight, such as greater than about 3% by weight, such as greater than about 5% by weight, such as greater than about 6% by weight of the oil resistant article. The oil resistant coating generally is present on the basesheet in an amount such that the oil resistant coating comprises less than about 10% by weight, such as less than about 8% by weight, such as less than about 6% by weight of the oil resistant article. As described above, the oil resistant article can contain a single oil resistant coating on one side of the basesheet or can include two oil resistant coatings positioned on opposite sides of the basesheet.

The oil resistant coating can be applied to the basesheet using any suitable method or technique. In one aspect, for instance, the oil resistant coating can be applied to the basesheet using a size press. By using a size press, the oil resistant article of the present disclosure can be produced in a single process. Alternatively, however, the basesheet can first be formed and later coated with the oil resistant coating. Other methods for applying the oil resistant coating include knife coating, gravure printing, and the like.

After the oil resistant coating is formed on the basesheet, in one embodiment, the resulting article can be calendered if desired.

The oil resistant article of the present disclosure maintains a relatively high permeability in relation to past oil resistant sheets, while still having the desired oil resistant properties. For example, the Gurley permeability of the oil resistant article can be less than about 50,000 s/100 mL, such as less than about 40,000 s/100 mL, such as less than about 30,000 s/100 mL, such as less than about 20,000 s/100 mL, and generally greater than about 3,000 s/100 mL, such as greater than about 5,000 s/100 mL, such as greater than about 8,000 s/100 mL.

Even while having a relatively high permeability, articles made according to the present disclosure have excellent oil resistant properties. Oil resistance, for instance, can be measured using a Kit oil test. The Kit oil test, for instance, can be measured using TAPPI Test Method T 559 cm-02 (2002). To measure oil resistance using the Kit oil test, 12 test solutions containing different mixtures of toluene, n-heptane, and castor oil are premixed.

Each Kit oil is dropped on the substrate to be tested. When any dark spot is formed, the oil resistance is unacceptable. When no spot is formed, the oil resistance is evaluated as acceptable. The oil resistance is expressed in terms of the maximum Kit solution for which the oil resistant is acceptable. The larger the number of mixed solvent, the better the oil resistance of the paper. Oil resistant articles made according to the present disclosure can have a Kit oil test rating of generally greater than 3, such as greater than 4, such as greater than 5, such as greater than 6, such as greater than 7, such as greater than 8, such as greater than 9, such as greater than 10. The Kit oil test rating is generally less than 12, such as less than 11.

The above results are dramatic considering that the oil resistant article of the present disclosure is made from recyclable materials. For instance, the oil resistant article is repulpable. In addition, the oil resistant article is made without having to use highly refined pulp fibers. Further, the oil resistant article can be formed without containing any fluorocarbon compounds or silicone compounds.

The present disclosure may be better understood with reference to the following example.

Example

An oil resistant article was made in accordance with the present disclosure and tested for oil resistance. The oil resistant article contained a wetlaid basesheet made from 100% hardwood fibers. The basesheet also contained a carboxymethyl cellulose binder, a cationic starch binder, and an alkyl ketene dimer sizing agent. The pulp fibers used to form the basesheet had a degree of refining of less than 85° SR.

The basesheet was coated with an oil resistant coating made from a carboxymethyl cellulose. The oil resistant article had a basis weight of about 35 gsm and had a Kit oil rating of 6. The Gurley permeability of the oil absorbent article was greater than 5,000 s/100 mL A similar product was made using a different carboxymethyl cellulose having a higher viscosity number to form the oil resistant coating. The resulting product displayed a Kit oil rating of only 3.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An oil resistant article comprising:

a paper basesheet comprising pulp fibers, the basesheet having a basis weight of from about 18 gsm to about 80 gsm, the basesheet including a first side and a second and opposite side;

an oil resistant coating on at least one side of the basesheet, the oil resistant coating comprising a cellulose derivative, a polyvinyl alcohol polymer, a vegetable protein-based polymer or mixtures thereof; and wherein the oil resistant article is free of fluorocarbon compounds, and wherein the oil resistant article has a Gurley permeability of less than about 50,000 s/100 mL and greater than about 3,000 s/100 mL.

2. An oil resistant article as defined in claim 1, wherein the pulp fibers contained in the basesheet have a degree of refining of from about 85° SR or less and about 50° SR or more.

3. An oil resistant article as defined in claim 1, wherein the basesheet contains hardwood fibers in an amount of about 60% by weight or more.

4. An oil resistant article as defined in claim 1, wherein the oil resistant coating comprises a sodium salt of a carboxymethyl cellulose, the sodium salt of the carboxymethyl cellulose having a viscosity of less than about 800 cPs and greater than about 5 cPs.

5. An oil resistant article as defined in claim 1, wherein the oil resistant coating comprises from about 0.01% to about 10% by weight of the oil resistant article.

6. An oil resistant article as defined in claim 1, wherein the basesheet further comprises a binder.

7. An oil resistant article as defined in claim 6, wherein the binder comprises a carboxymethyl cellulose, a starch or mixtures thereof.

8. An oil resistant article as defined in claim 6, wherein the binder comprises a first carboxymethyl cellulose and the oil resistant coating comprises a second carboxymethyl cellulose, the first carboxymethyl cellulose being different than the second carboxymethyl cellulose.

9. An oil resistant article as defined in claim 1, wherein the basesheet further comprises a sizing agent.

10. An oil resistant article as defined in claim 9, wherein the sizing agent comprises an alkyl ketene dimer, the alkyl ketene dimer being present in the basesheet in an amount from about 0.5% to about 4% by weight.

11. An oil resistant article as defined in claim 1, wherein the basesheet has an uncoated, inherent permeability of from about 1,000 s/100 mL to about 3,000 s/100 mL.

12. An oil resistant article as defined in claim 1, wherein the oil resistant article includes an oil resistant coating on the first side of the basesheet and an oil resistant coating on the second side of the basesheet.

13. An oil resistant article as defined in claim 1, wherein the basesheet does not contain filler particles.

14. An oil resistant article as defined in claim 1, wherein the oil resistant coating does not contain filler particles.

15. An oil resistant article as defined in claim 1, wherein the article comprises a single coated layer made only from the basesheet and one or more oil resistant coatings.

16. An oil resistant article as defined in claim 1, wherein the article displays a Kit oil rating of greater than about 3 and less than about 12.

17. An oil resistant article as defined in claim 1, wherein the oil resistant article is silicone free.

18. An oil resistant article as defined in claim 1, wherein the basesheet has a basis weight of from about 30 gsm to about 50 gsm.

19. An oil resistant article as defined in claim 1, wherein the article has a Gurley permeability of from about 5,000 s/100 mL to about 15,000 s/100 mL.

20. An oil resistant article as defined in claim 1, wherein the pulp fibers contained in the basesheet comprise at least about 95% by weight hardwood fibers.

21. An oil resistant article as defined in claim 1, wherein the oil resistant article has been calendered.

22. An oil resistant article comprising:

a paper basesheet comprising pulp fibers, the basesheet having a basis weight of from about 18 gsm to about 80 gsm, the basesheet including a first side and a second and opposite side;

an oil resistant coating on at least one side of the basesheet, the oil resistant coating comprising a cellulose derivative, a polyvinyl alcohol polymer, a starch, a vegetable protein-based polymer or mixtures thereof;

wherein the oil resistant article is free of fluorocarbon compounds, and wherein the oil resistant article has a Gurley permeability of less than about 50,000 s/100 mL and greater than about 3,000 s/100 mL; and wherein the basesheet does not contain any filler particles and wherein the pulp fibers contained in the basesheet have a degree of refining of from about 85° SR or less and about 50° SR or more.

* * * * *